US006321407B1

(12) United States Patent
Weihrauch

(10) Patent No.: US 6,321,407 B1
(45) Date of Patent: Nov. 27, 2001

(54) TOOTHBRUSH

(75) Inventor: Georg Weihrauch, Wald-Michelbach (DE)

(73) Assignee: Coronet-Werke GmbH, Wald-Michelbach (DE)

( * ) Notice: Subject to any disclaimer, the term of this patent is extended or adjusted under 35 U.S.C. 154(b) by 0 days.

(21) Appl. No.: 09/463,848

(22) PCT Filed: Jul. 22, 1998

(86) PCT No.: PCT/EP98/04603

§ 371 Date: Feb. 1, 2000

§ 102(e) Date: Feb. 1, 2000

(87) PCT Pub. No.: WO99/07252

PCT Pub. Date: Feb. 18, 1999

(30) Foreign Application Priority Data

Aug. 5, 1997 (DE) ..... 197 33 758

(51) Int. Cl.[7] ..... A46B 9/04
(52) U.S. Cl. ..... 15/167.1; 15/207.2
(58) Field of Search ..... 15/167.1, 207.2

(56) References Cited

U.S. PATENT DOCUMENTS 4,690,277 * 9/1987 Lewis .
4,724,569 * 2/1988 Eguchi et al. .
5,797,158 * 8/1998 Hoshizaki et al. .
5,850,660 * 12/1998 O'Halloran .

FOREIGN PATENT DOCUMENTS 503 714 7/1930 (DE) .
34 33 763 2/1986 (DE) .
36 28 722 2/1988 (DE) .
42 01 873 5/1993 (DE) .
93 03 339.7 7/1993 (DE) .
94 06 648 6/1994 (DE) .
43 11 186 10/1994 (DE) .
295 02 119.5 3/1995 (DE) .
44 20 911 3/1995 (DE) .
296 00 139 4/1996 (DE) .
195 07 364 9/1996 (DE) .
195 13 451 10/1996 (DE) .
WO96 27308 9/1996 (WO) .

* cited by examiner

*Primary Examiner*—Terrence R. Till

(57) ABSTRACT

A toothbrush having a brush head made from plastic and vertical individual bristles made from plastic embedded into the brush head which are disposed at small separations with respect to each other, is distinguished in that, on the bristle head portion having bristles, approximately 400 to 800 individual bristles per $cm^2$ are disposed and the overall height of the toothbrush comprising the free length of the individual bristles and the thickness of the brush head assumes a value between 6.5 and 11 mm.

13 Claims, 2 Drawing Sheets

TOOTHBRUSH

BACKGROUND OF THE INVENTION

The invention concerns a toothbrush having a brush head made from plastic and individual plastic bristles vertically embedded into the brush head disposed at a small separations with respect to each other.

Toothbrushes of this type are known in the art (WO 96/27 308). In contrast to conventional toothbrushes with which the bristles are collected into individual bundles and a plurality of bundles are mounted to the brush head, the above mentioned toothbrushes have the advantage that the ends of the bristles which are substantially active during cleaning are evenly distributed over the entire brush surface so that the medically recommended cleaning method from red to white, that is to say a substantially vertical guiding of the brush with an overlapping slightly pivoting motion, leads to cleaning (of the teeth) and massaging (of the gums) in the entire region swept over by the bristle stock. With toothbrushes having the conventional bundle stock, certain parts of the gums and or teeth remain untreated. One had tried to counteract this problem by disposing the bristles in a non-parallel fashion within the bundle so that they were spread apart. This had however, during cleaning, the consequence that the bristles stood at differing angles with respect to the surface being cleaned. This can cause injury to the gums. In addition, the tilted bristles are more active in the transitional region towards the side of the bristle than at their rounded bristle ends. Since such transition regions can be edged if the bristles are not perfectly rounded, injury to the gums or fine lesions of the enamel can result.

Among other factors, the flexural strength of the bristles is important for the effectiveness of the toothbrush. In a bundle, this is substantially determined by the length of the bundle and the packing density of the bristles in the bundle as well as by the diameter of the individual bristles, wherein the latter has the smallest influence of all since the bristles in the bundle support one another so that the flexural strength of the bundle is many times larger than that of the individual bristles. In the above mentioned conventional toothbrush (WO 96/27 308) having individually standing bristles, the flexural strength is additionally influenced by the separation of the bristles from another. Due to this separation, the influence of the bristle diameter is more prominent than in bundles. The flexural strength can thereby be varied in steps finer than those standard with conventional toothbrushes: namely, "soft", "middle" and "hard". The reduced embedded length of the individual bristles compared to bundles allows the height of the brush head to be reduced.

Dentistry has pointed out that the care and cleaning of the molar teeth, in particular on the outer side of the teeth (distal), is substantially worse than in the front tooth region. This has to do with the poor accessibility of the molars, the frequently confined space of the distal region which, given abnormalities in tooth formation, can assume serious dimensions, and the frequent increased sensitivity and irritation in the distal region of the molars which, depending on how the toothbrush is introduced, can even induce vomiting. Even the red-white cleaning method recommended by dentists, can not be properly carried out in the molar region due to the confined space. The increased pressure also causes injury to the gums and lesions in the enamel in this region.

It is the underlying purpose of the invention to create a toothbrush which also permits easy application in the molar region allowing the red-white method to be carried out and particular facilitating equally satisfactory cleaning of the molar regions in the distal area.

SUMMARY OF THE INVENTION

Departing from the toothbrush in accordance of the pre-characterizing part of claim 1 WO 96/27 308, this purpose is achieved in accordance with the invention in that the portion of the brush head having bristles contains approximately 400 to 800 individual bristles per $cm^2$ and the overall height of the toothbrush resulting from the free length of the individual bristles and the thickness of the brush head assumes a value between 6.5 and 11 mm.

The toothbrush in accordance with the invention is initially distinguished by an extremely small height formed from the free bristle length and the thickness of the brush head. This height assumes values between 6.5 and 11 mm, whereas the conventional toothbrushes extend up to 20 mm. Due to this flat construction, it is also easy to clean the distal region of the molars and the red-white method can be utilized in this location with the applied pressure being completely determined by the user, since even the inner sides of the cheeks no longer exercise any pressure on the toothbrush. The plurality of narrowly separated individual bristles also allows for adjustment of the flexural strength despite the reduced length of the individual bristles in a user specific manner.

Flat toothbrushes have been proposed (DE 93 03 339 U1) with which the horizontal length of conventional brushes having bundles has simply been shorted. This, however, leads to an increase in the stiffness of the conventional toothbrush having bristle bundles. This was, in fact, the specific intent of this prior art in order to achieve improved mechanical friction. Precisely this is, however, undesirable for medical reasons.

Another conventional embodiment (EP 0 060 592) led to the same negative effects. In this embodiment, the individual bristles are disposed at narrow separation from each other and held in a frame-like brush head structure. In this case, the flexural strength is even larger than for bristle bundles, since the individual bristles support each other along their entire length.

An additional conventional toothbrush (DE 296 00 139 U1) has microfibers introduced onto the brush head proximate conventional bristle bundles. These microfibers are of low flexural strength and therefore extremely soft so that they cannot exercise any mechanical effect on the tooth coating. They have, at most, a polishing effect. Such microfibers can also not be directly attached to the brush head due to their extremely small diameter.

The configuration in accordance with the invention is equally effective both for manual toothbrushes having a handle attached to a brush head as well as for electrically driven toothbrushes with which the brush head is mounted onto a drive.

It is preferred when the free length of the individual bristles assumes a value between 5 and 9.5 mm and the thickness of the brush head a value between 1.5 and 3.0 mm. The low thickness of the brush head is particularly facilitated by the fact that the individual bristles must only be embedded over a small length in the brush head plastic in order to achieve the necessary pull-out strength.

The configuration in accordance with the invention further allows a shape to be given to the active brush surface, wherein the free ends of the individual bristles lie on a constant or varying curved enveloping surface the separation of which from the brush head surface varies by up to 3 mm.

This topography guarantees that not only the surfaces of the teeth but also the inter-dental regions are reached and cleaned by the bristles. In the vicinity of the gums, special massage effects result with the longer bristles being deflected when pressed to act along the outer portion of the bristles and cause a rubbing massage motion. The shorter bristles are active at their ends.

An additional variation for the flexural strength can be achieved when the diameter of the individual bristles lies between 0.095 and 0.225 mm with the chosen effective diameter being smaller, the smaller the free length of the individual bristles.

It is thereby preferred, with a free length for the individual bristles of between 5 to 7 mm, for their diameter to be chosen between 0.095 and 0.175 and, with a free length of 7 to 9.5 mm, to have a diameter between 0.125 and 0.225 mm.

A preferred embodiment of the toothbrush in accordance with the invention is distinguished by a height of the toothbrush of approximately 8.5 mm with a free length of the individual bristles of 7 mm and a thickness of the brush head of 1.5 mm and with approximately 600 bristles per $cm^2$.

In an additional advantageous configuration of the invention, the individual bristles are embedded into the brush head by injection molding their attachment sided ends with the plastic of the brush head.

This method for attaching the individual bristles leads to the largest possible pull-out strength for the shortest possible embedded length. The individual bristles in the vicinity of their attachment are completely surrounded by the plastic of the brush head so that a gap free surface is guaranteed. This is desirable for hygienic reasons.

The configuration in accordance with the invention also allows for the brush head to have a convex bulged surface at its side facing the bristles with the individual bristles being approximately perpendicular to the surface.

In this configuration, the ends of the bristles, to the extent that they are of equal length, lie on a corresponding convex enveloping surface. This facilitates, in connection with the red-white method with which the toothbrush is normally slightly pivoted, a better engagement by the bristle ends. In conventional bundle toothbrushes, one had attempted to achieve the same effect by having the bundle be perpendicular to the surface only along the longitudinal middle axis of the brush head and tilted in an outer direction with associated substantial shortening of the outer lying bundles. This tilted configuration causes differing brushing and cleaning action for the individual bundles. In addition, the slanted configuration of the bristles is associated with the danger that they fold over in opposition to the cleaning direction and act as a spear. The convex configuration of the brush head within the framework of the invention is facilitated, without a substantial increase in the height, by the small thickness of the brush head.

In this embodiment, the back of the brush head can simultaneously be concave bulged so that the brush head has approximately the same thickness along its entire length without having the brush head excessively stiffened by this shape. In this embodiment, the individual bristles disposed perpendicular to the surface are preferentially of equal length.

The attachment sided ends of the individual bristles are preferentially embedded by an amount which is less than 10 times the diameter of the bristle. The embedded length assumes values, with the above mentioned diameter range of 0.125 to 0.225, of not more than 1.25 to 2.25 mm.

The invention is described below in connection with embodiments shown in the drawings.

DESCRIPTION OF THE PREFERRED EMBODIMENT

Figure 1:
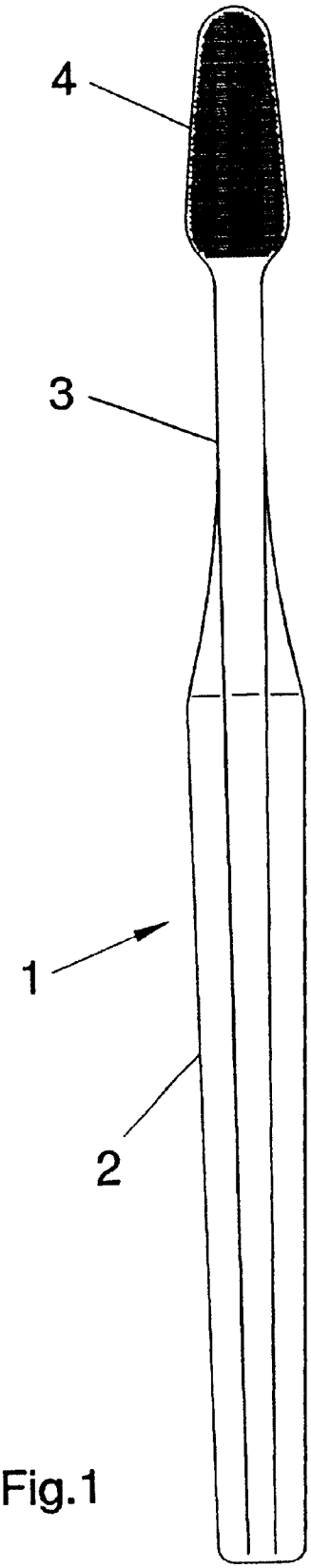
FIG. 1 shows a plan view of the bristle stock of a toothbrush.
Figure 2:
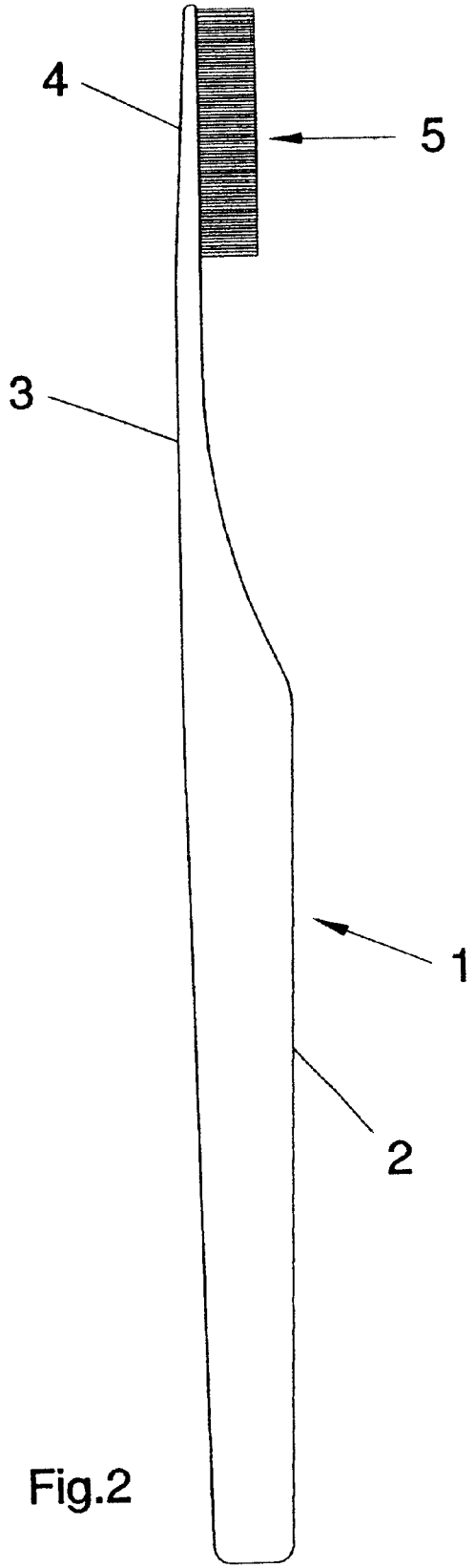
FIG. 2 shows a side view of a toothbrush in accordance with FIG. 1.
Figure 3:
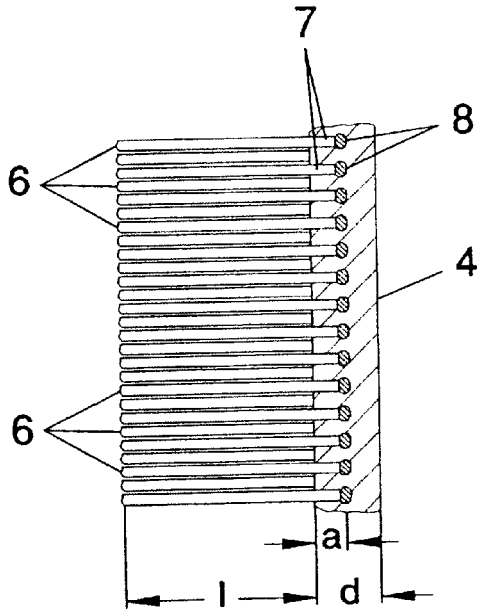
FIG. 3 shows an enlarged section of a longitudinal cut in the vicinity of the brush head.
Figure 4:
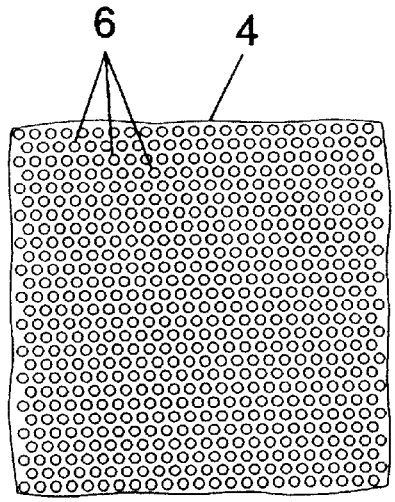
FIG. 4 shows a plan view of the illustration in accordance with FIG. 3.

FIGS. 1 and 2 show a toothbrush 1 used for manual applications. It has a handle 2 and a preferentially flexible neck 3 as well as a brush head 4 having bristle stock 5. The bristle stock 5 consists essentially of individually standing bristles disposed at small separations from each other, as can be seen from FIGS. 3 and 4. The individual bristles 5 are anchored at their ends 7 within the brush head 4. For example, the individual bristles have enlargements 8 molded at their ends 7 with which they are injection molded with and anchored in the plastic of the brush head 4.

The bristles 6 have a diameter between 0.095 and 0.225 mm and a free length "1" between 5 to 9.5 mm. The diameter is smaller, the shorter the free length "1". Practical experiments have shown the following configuration to be advantageous: diameter 0.095 to 0.175 mm with a free length "1" of 5 to 7 mm and diameter 0.125 to 0.225 mm with a free length of 7 to 9.5 mm.

The overall height of the toothbrush in the vicinity of the brush head is between 6.5 and 11 mm, wherein the thickness "d" of the brush head is between 1.5 and 3.0 mm. The embedded depth "a" of the individual bristles assume values between 0.2 and 0.8 mm, preferentially approximately 0.4 mm. The separation of the individual bristles 6 with respect to each other is preferentially chosen in such a fashion that there are approximately 600 bristles per $cm^2$ .

Figure 5:
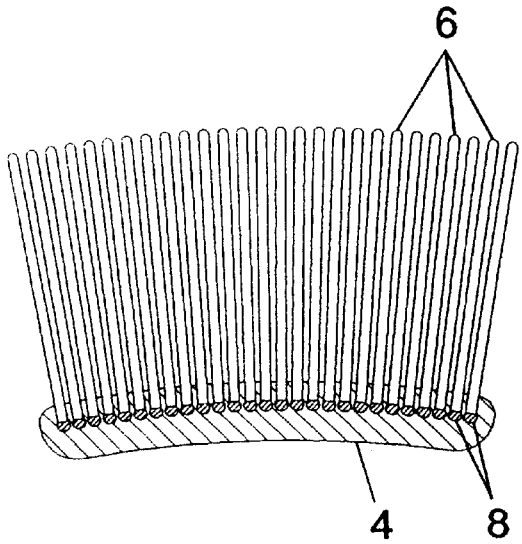
FIG. 5 shows a cross section through another embodiment of the brush head.

In the embodiment in accordance with FIG. 5, the brush head has a bulging cross section so that the ends of the individual bristles 6 lie on a correspondingly bulged enveloping surface. This enveloping surface can also be waved or stepped through differing lengths of the individual bristles 6. The individual bristles are perpendicular to the surface of the brush head 4.

What is claimed is:

1. A toothbrush comprising:

a brush head made from plastic, said brush head having a bristle surface; and individual standing bristles made from plastic, said bristles embedded into said brush head at said bristle surface, said bristles having a density of between 400 and 800 bristles per $cm^2$ at said bristle surface, wherein an overall height of the toothbrush is equal to a free length of said bristles plus a thickness of said brush head, said overall height being greater than 6.5 mm and less than 11 mm.

2. The toothbrush of claim 1, wherein said free length of said bristles is between 5 and 9.5 mm and said thickness of said brush head is between 1.5 and 3.0 mm.

3. The toothbrush of claim 1, wherein free ends of said bristles lie on an envelope surface, said envelope surface having one of a constant and a varying curvature, said envelope surface having a range of separations from said bristle surface of less than 3 mm.

4. The toothbrush of claim 1, wherein said bristles have a diameter of between 0.095 and 0.225 mm, wherein a chosen effective diameter is smaller, the smaller said free length of said bristles.

5. The toothbrush of claim 4, wherein said free length of said bristles is between 5 and 7 mm, and said diameter is between 0.095 and 0.175 mm.

6. The toothbrush of claim 4, wherein said free length of said bristles is between 7 and 9.5 mm and said diameter is between 0.125 and 0.225 mm.

7. The toothbrush of claim 1, wherein said overall height is approximately 8.5 mm, said free length is approximately 7 mm, and said thickness of said brush head is approximately 1.5 mm.

8. The toothbrush of claim 1, wherein said density is approximately 600 bristles per $cm^2$.

9. The toothbrush of claim 1, wherein said bristles are embedded in said plastic of said brush head using an extrusion procedure by injection molding said brush head plastic around bristle attachment ends.

10. The toothbrush of claim 1, wherein said bristle surface has a convex bulging shape, said bristles being approximately perpendicular to said bristle surface.

11. The toothbrush of claim 10, wherein said brush head thickness is approximately constant, said brush head being curved in a convex fashioned at said bristle surface and in a concave manner at a back surface opposite said bristle surface.

12. The toothbrush of claim 10, wherein said individual bristles have a constant length.

13. The toothbrush of claim 1, wherein said bristles are embedded at attachment ends along a length which is less than 10 times a diameter of an individual bristle.

* * * * *